United States Patent [19]

Bunce

[11] 4,238,908

[45] Dec. 16, 1980

[54] FORMED METAL PANELS

[75] Inventor: Donald A. Bunce, Irby, England

[73] Assignee: White Consolidated Industries, Inc., Cleveland, Ohio

[21] Appl. No.: 933,429

[22] Filed: Aug. 14, 1978

[30] Foreign Application Priority Data

Aug. 16, 1977 [GB] United Kingdom ..... 34383/77

[51] Int. Cl.[3] ..... E06B 3/00

[52] U.S. Cl. ..... 49/501; 49/489

[58] Field of Search ..... 49/488, 489, 486, 402, 49/501, 382

[56] References Cited

U.S. PATENT DOCUMENTS

| | | | |
|---|---|---|---|
| 2,166,629 | 7/1939 | White | 49/486 |
| 2,507,305 | 5/1950 | Jacobs | 49/486 |
| 2,694,235 | 11/1954 | Jansen | 49/388 X |
| 3,430,386 | 3/1969 | Sandin et al. | 49/382 |
| 4,056,211 | 11/1977 | Zumwalt | 49/501 X |

*Primary Examiner*—Kenneth Downey

*Attorney, Agent, or Firm*—Pearne, Gordon, Sessions, McCoy & Granger

[57] ABSTRACT

A metal panel, particularly though not exclusively for use as an outer panel of a refrigerator door or hinged freezer lid, has a peripheral lip forming an inwardly facing channel. The channel is formed by two folds, the outer fold being formed by roll-forming operations and the inner by a folding machine or the like. This (a) permits the panel forming machine to be more readily adjustable for different sizes of panels, (b) permits the lip to be made up of a number of folds (which strengthens the panel and permits thinner metal to be used), (c) avoids the need for corner welding, (d) permits a lip profile into which a gasket can be snap-fitted and (e) permits precoated metal sheet to be used.

1 Claim, 11 Drawing Figures

FIG. 2
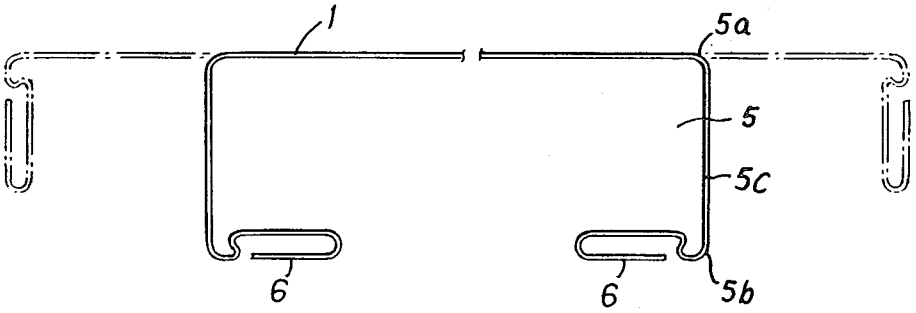
FIG. 3
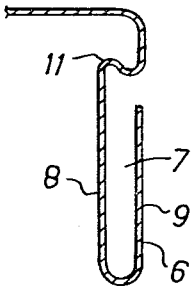
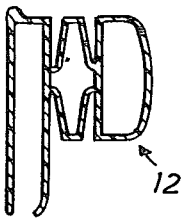
FIG. 4
FIG. 5
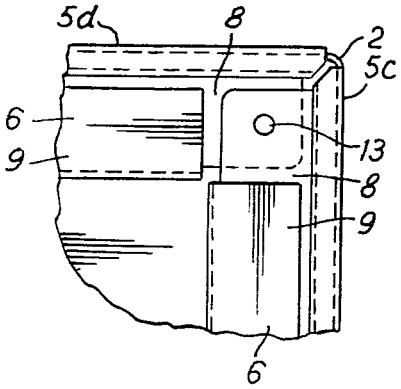
FIG. 6
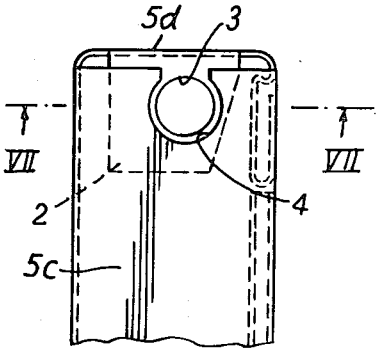

FORMED METAL PANELS

This invention relates to flanged metal panels and particularly though not exclusively to the outer panels of refrigerator doors and hinged freezer lids.

Refrigerator outer door panels are conventionally made of sheet steel which is formed to provide a peripheral flange bent up at right angles along all four edges, and inwards substantially parallel to the main part of the panel, to provide an inwardly facing lip and an inwardly facing channel defined thereby. The lip forms a mounting for clips for a sealing gasket and fasteners for an inner door panel. One of the difficulties that has been encountered in the manufacture of such refrigerator doors is that the tooling is such that only specific sizes can be made. For example, the door panel can be made from a rectangular blank with square cut-outs at each corner by forming the edges of the blank about a former and then withdrawing the former inwardly to release the completed panel therefrom; the tooling for such an arrangement is complicated by the fact that there are channels on all four edges of the panel and the arrangement is not adjustable for different door sizes. It is also possible to make the channel using a folding machine but a folding machine which forms two folds in each panel edge is necessarily relatively complex and heavy and it is not very practicable to make its width adjustable to suit different door sizes.

Another problem which is encountered in the manufacture of refrigerator door panels by conventional techniques is the need to use relatively heavy gauge steel to give the panel rigidity.

It has now been discovered that either or both of these problems can be solved by using roll-forming to shape the panel edges. Adjustable roll-forming machines are standard equipment and can be used to form relatively complex shapes in panel edges to give the necessary reinforcement in the case of thin sheet. However, roll-forming has never previously been used for making these panels because an inturned channel has to be formed on all four edges thus apparently precluding a second pass at right angles to a first pass. However, the present invention uses roll-forming to form the outer fold of the channel (and preferably other folds described below), the inner fold of the channel being formed by static means such as a folding machine. It will be appreciated that if a folding machine only provides one fold it may be relatively simple and inexpensive and, furthermore, may be readily adjustable to different panel sizes. The second roll-forming pass is not obstructed by the edge formed by the first pass since the rolls are clear of the ends of this edge (a corner cut-out having been provided in the usual way).

Thus, broadly stated, the invention provides a metal panel having a peripheral flange providing an inwardly facing channel, wherein the channel is formed by two parallel folds in the metal and the outermost fold has been made by a roll-forming operation.

Thin steel is not suitable for corner-welding which is, in any case, a labour-intensive operation, so, in accordance with a preferred feature of the invention, welding is dispensed with and a corner cap is used to cover the corner.

A further advantage obtained using the preferred forms of the invention is that panel edge can be formed in such a way that it holds a sealing gasket with a snap fit.

Preferred forms of the invention will now be described with reference to the accompanying drawings in which:

FIG. 2 is a horizontal section through the panel of FIG. 1 showing an intermediate stage of formation in ghost lines;

FIG. 3 shows a lip shown in FIG. 2 on a larger scale;

FIG. 4 shows a section of a resilient gasket designed to snap into the lip of FIG. 5;

FIG. 5 is a detail view of the top right hand corner of FIG. 1;

FIG. 6 is a top view of the part shown in FIG. 5;

Figure 1:
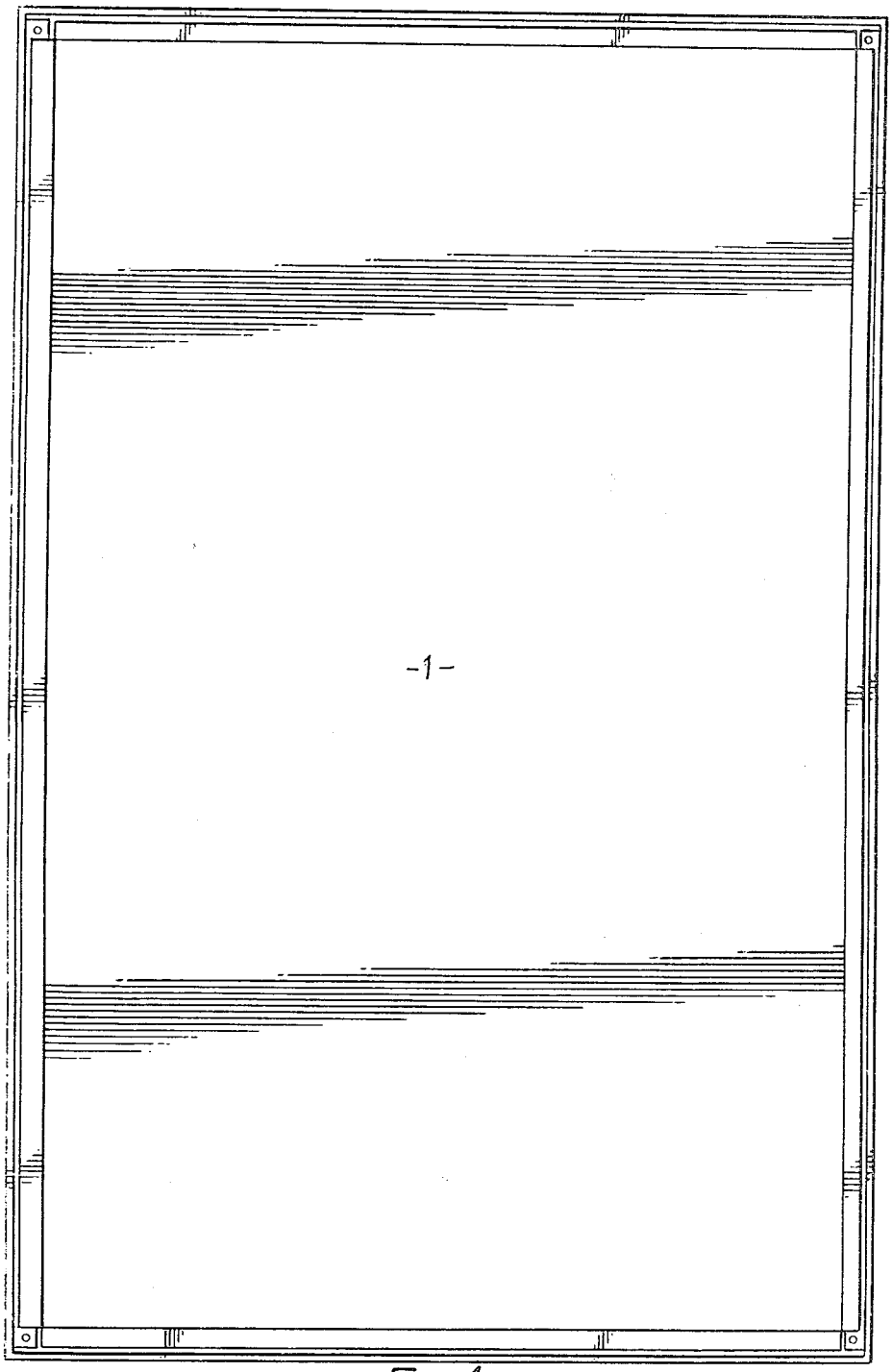
FIG. 1 is an inside elevation of a completed panel.

The completed panel shown in FIGS. 1 to 3 and 5 to 7 is of thin sheet steel and has a peripheral inwardly facing channel 5 formed by a lip 6 and an inner fold 5*a* and an outer fold 5*b* with an outer wall therebetween. The long outer walls are denoted as 5*c* and the short outer walls as 5*d*.

The lip 6 has a profile as shown in FIG. 3. The sheet metal is doubled back on itself to provide a channel 7 with an inner wall 8 and a slightly shorter outer wall 9. The inner wall is joined to the rest of the panel by an S-bend 11 so that the channel profile is effectively open only at one side and not at the end. This means that the resilient gasket 12 shown in FIG. 4 can be pushed into the channel 7 under compression but expands once inside so that it is difficult to remove; the conventional clips are thereby dispensed with. Also relatively few fasteners are needed for securing the inner door panel since the combined gasket clips and inner panel fasteners of conventional doors have to be closely spaced only because of the need to secure the gasket. Furthermore the substantial number of bends in the lip profile are easy to provide by roll-forming and greatly increase the door strength.

As will be seen from FIG. 5, the outer channel walls 9 stop short of the corners and the inner walls 8 are fastened e.g. by a pop rivet 13.

The corners of the panel are secured by tabs 2 extending from the ends of channel outer walls 5*c* and bent through a right angle to lie face to face with the inside of channel outer walls 5*d*. Each tab 2 has a hole 3 and the corresponding edge of the transverse channel wall 5*d* has a corresponding hole or key-hole slot 4.

Figure 7:
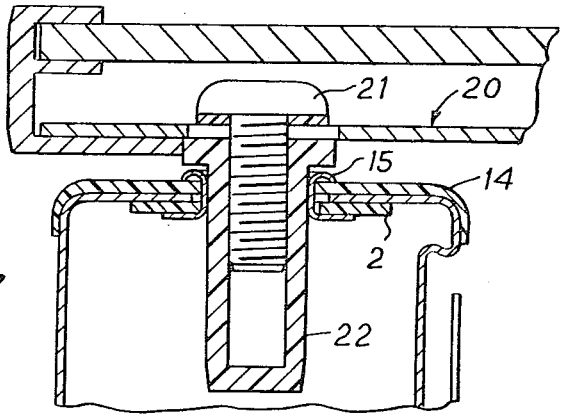
FIG. 7 is a section on the line VII—VII of FIG. 5 but showing a hinge mounting.
Figure 9:
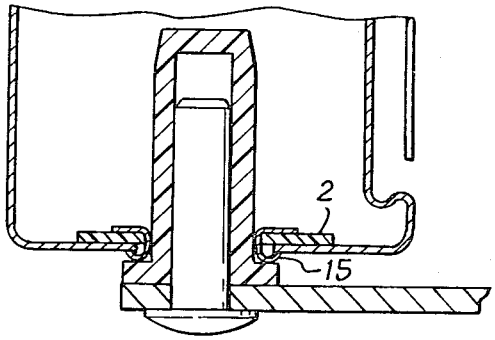
FIG. 9 shows a plastics corner cap used in FIGS. 7 and 8.
Figure 9:
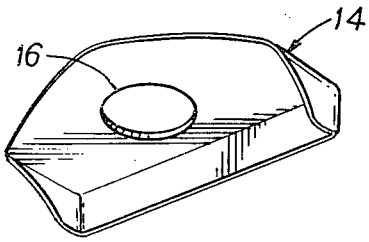

Turning now to FIG. 7, the plastics corner cap 14 shown in FIG. 9 is secured in position to seal the corner by a metal eyelet 15 passing through its central hole 16, through the keyhole slot 4 and through the hole 3 in the tab 2. The eyelet 15 is inserted and crimped in conventional manner. A conventional horizontally extending arm 20 carries a screw 21 and nylon bush 22 in the usual way but in accordance with the present invention the eyelet 15 forms the bearing for the bush 22.

Figure 8:
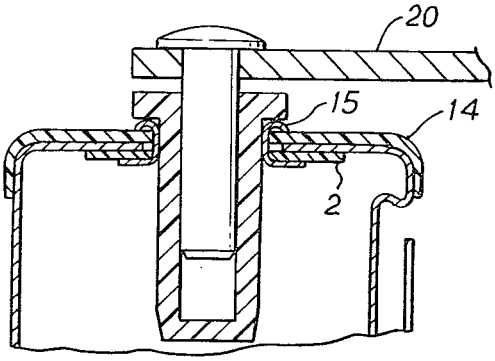
FIG. 8 shows a modification of FIG. 7 also including a lower hinge mounting.

FIG. 8 shows how a slightly different conventional upper hinge arrangement is modified in accordance with the invention. As shown in FIG. 8 the lower hinge arrangement is similar to the upper hinge arrangement;

in fact the lower hinge arrangement shown in FIG. 8 can conveniently be used with the upper hinge arrangement shown in FIG. 7. It will be noted that the corner cap can be omitted at the lower end of the door.

There will of course be two eyelets at the top and bottom respectively of the other end of the door (i.e. the lock side). The top one is closed by a plastics push-in plug with a snap fit and the lower one is closed either by a similar plug or simply by a length of adhesive tape on the inside. The door is thus automatically produced in a form suitable for left hand or right hand hinging.

The space between the inner and outer door panels can be filled with insulating material in a conventional manner.

The door panel can be made of plain steel (and subsequently painted), of prepainted steel or of precoated steel such as vinyl-coated steel (Stelvetite). Prepainted or precoated steel is advantageous in practice since subsequent painting of door panels can involve a substantial captial outlay and/or production hold ups. The bends illustrated in the drawings are of a nature not to cause surface cracking of suitable precoated steels.

The panel is made as follows.

Figure 10:
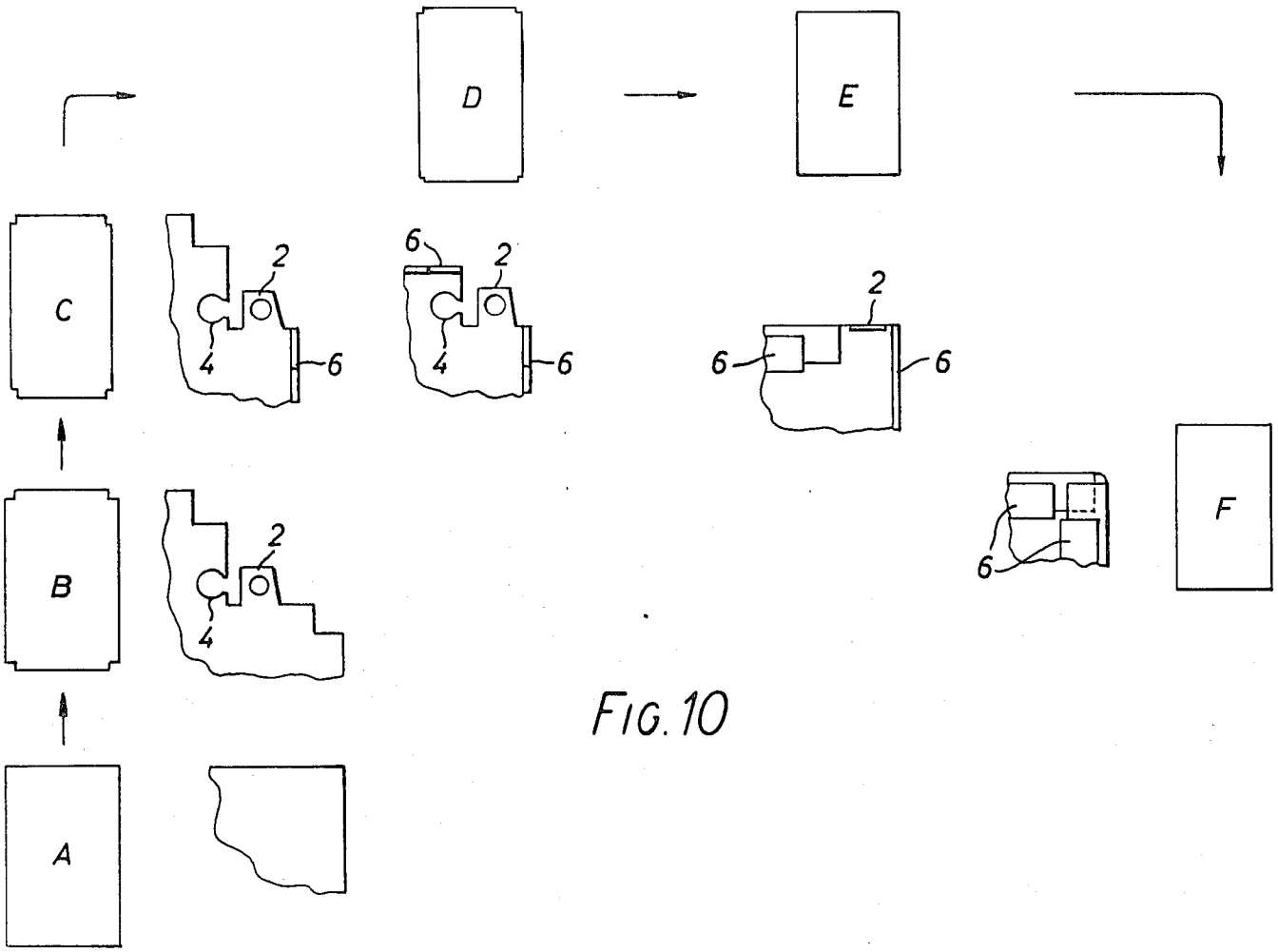
FIG. 10 shows diagrammatically in plan view the path of a panel through various forming stages.

FIG. 10 shows diagrammatically in plan view the passage of a blank through stations A to F to form a panel. Alongside each station there is shown an enlarged diagrammatic plan view of the top right hand corner of the blank as it leaves the station. At station A there is a rectangular metal blank. This blank passes on a conveyor belt to station B where the corners are cut out by a conventional notching machine using four punch/die combinations, one for each corner their relative positions are adjustable for different door sizes. At station C, the long sides of the panel are roll-formed e.g. by a dual head roll-forming machine of the type produced by Yoder in the U.S.A. and by Shorte Engineering Equipment Limited in the U.K. The profile shown in FIG. 3 can be produced by approximately 16–18 rolls in a manner conventional in the roll-forming art. The roll-units can be moved away from and towards each other to accommodate panels of different sizes.

After leaving station C, the panel runs up against a stop and is then moved sideways through station D which comprises a similar roll-forming machine which performs a similar operation on the short ends of the panel. When it enters station D the panel has upstanding longitudinal edges (c.f. the ghost line configuration of FIG. 2) but there is plenty of room for the rolls to operate beyond their ends.

Figure 11:
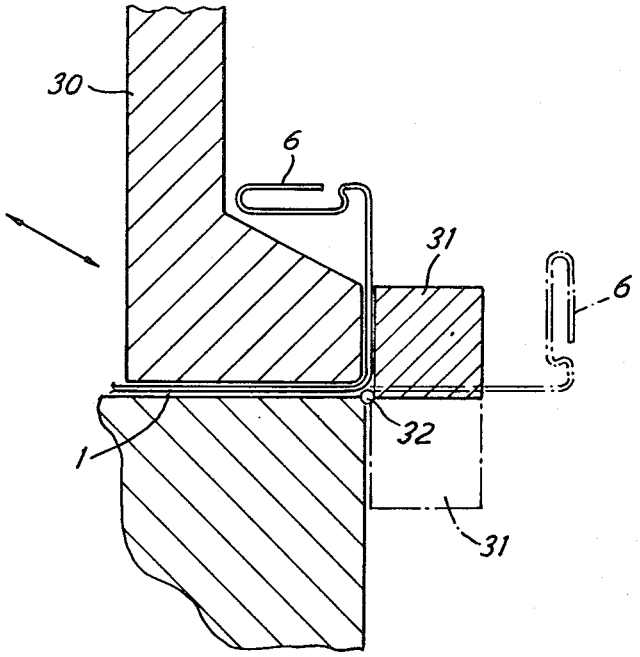
FIG. 11 shows diagrammatically in vertical section how the folding operation is performed.

At station E the panel stops and the short ends of the panel are folded in an automatic folding machine of conventional type. Its operation is shown diagrammatically in FIG. 11. One folding bar 30 moves down into position as shown by the arrow with the panel being as shown in ghost lines, and a second folding bar 31 is then swung upwards, e.g. by an air cylinder, from its ghost line position to its full line position about a pivot 32. After folding, the bar 30 is retracted along the line of the arrow and withdrawn and the bar 31 swung down again. The folding machine is adjustable for different panel sizes. It will be noted that the folding operation simultaneously bends up the tabs 2 to their final position.

After station E, the panel again changes direction through a right angle and the long sides are folded by a similar adjustable folding machine (F) except that this machine has withdrawable corner pieces. Such corner pieces are well known to experts in the metal forming art and will not be described here.

Important features of the door panel described include:

1. It is made by using roll forming and folding in such a manner as to produce doors and lids of different sizes only requiring the changing of folding parts on the final operation.

2. It has upstanding flanges which are unjoined or joined by an overlap joint at the corners.

3. The corner is covered by a corner cap thus avoiding welding and metal finishing operations.

4. The overlap joint provides hinge holes at all four corners, preferably with eyelets therein.

5. The panel has an inwardly facing lip for mounting an inner door panel in which the lip is profiled to retain a resilient gasket.

6. The profile is such that the gasket fits with a snap fit.

The invention provides a metal door panel or the like with any or all of these features.

I claim:

1. A rectangular refrigerator door panel formed from a single sheet of sheet material, comprising a central panel of rectangular shape, an integral outer wall on each side of said central panel joined at its inner side to said central panel at a first fold and extending substantially perpendicular to said central panel, an integral channel portion joined at a second fold to the outer side of each outer wall and extending around all sides of the panel and toward the center of the panel generally parallel to said central panel, said channel portion including a pair of spaced, parallel, inner and outer channel walls joined together by an integral inner end wall away from said panel outer wall, said channel portion including an outer end wall extending between said inner channel wall and said second fold and defining a gap with said outer channel wall, said outer end wall having a re-entrant portion adjacent said inner channel wall, a resilient gasket carried in said channel portion and extending outwardly from said gap over said outer channel wall, said gasket having a portion extending into said re-entrant portion to retain said gasket in place within said channel portion, said panel having one outer wall which at both end intersections with adjacent other outer walls has a tab bent at a right angle to underlie a portion of the adjacent outer wall, and a hollow rivet at each end extending through the adjacent tab and other outer wall to define a hinge axis and serve as bearings for opposed hinge pintles.

* * * * *